US011763717B2

(12) United States Patent
Xie

(10) Patent No.: US 11,763,717 B2
(45) Date of Patent: Sep. 19, 2023

(54) DISPLAY SCREEN, DRIVE CONTROL METHOD AND DRIVE-CONTROL APPARATUS THEREOF

(71) Applicant: SUZHOU JIAOTU ELECTRONICS CO. LTD., Jiangsu (CN)

(72) Inventor: Qingqing Xie, Jiangsu (CN)

(73) Assignee: SUZHOU JIAOTU ELECTRONICS CO. LTD., Jiangsu (CN)

( * ) Notice: Subject to any disclaimer, the term of this patent is extended or adjusted under 35 U.S.C. 154(b) by 0 days.

(21) Appl. No.: 17/684,515

(22) Filed: Mar. 2, 2022

(65) Prior Publication Data

US 2022/0189371 A1 Jun. 16, 2022

Related U.S. Application Data

(63) Continuation of application No. PCT/CN2020/137170, filed on Dec. 17, 2020.

(30) Foreign Application Priority Data

Dec. 26, 2019 (CN) ..... 201911366418.3

(51) Int. Cl.
*G09G 3/20* (2006.01)

(52) U.S. Cl.
CPC ..... *G09G 3/20* (2013.01); *G09G 2310/0267* (2013.01); *G09G 2320/0271* (2013.01); *G09G 2330/023* (2013.01)

(58) Field of Classification Search
CPC ..... G09G 3/20; G09G 2310/0267; G09G 2320/0271; G09G 2330/023
See application file for complete search history.

(56) References Cited

U.S. PATENT DOCUMENTS 7,683,862 B2 * 3/2010 Lee ..... G09G 3/3283 345/82
2007/0234152 A1 10/2007 Kwon et al.
(Continued)

FOREIGN PATENT DOCUMENTS

CN 202003648 U 10/2011
CN 105448255 A 3/2016
(Continued)

OTHER PUBLICATIONS

International Search Report of PCT/CN2020/137170, dated Feb. 25, 2021.

*Primary Examiner* — Kenneth B Lee, Jr.
(74) *Attorney, Agent, or Firm* — Locke Lord LLP; Tim Tingkang Xia, Esq.

(57) ABSTRACT

The present invention provides a drive-control method and control apparatus of display screens, and a display screen thereof, the method includes: determining a staged target gray-scale value of all sub-pixels in the currently scanned row, based on a current gray-scale value of each sub-pixel, the staged target gray-scale value and a pre-stored look-up table, determining the charging-discharging target count corresponding to each column channel in the current scan row, terminating the charging-discharging of the column channel, when the count of the counter is consistent with the target count corresponding to the charging or discharging of each column channel. The present invention in implementation not only has simple structure and a small scale circuit, but also low power consumption.

10 Claims, 5 Drawing Sheets

(56) References Cited

U.S. PATENT DOCUMENTS

| | | | | |
|---|---|---|---|---|
| 2012/0044275 | A1* | 2/2012 | Kobayashi | G09G 3/20 345/690 |
| 2012/0280965 | A1 | 11/2012 | Lee | |
| 2014/0320464 | A1 | 10/2014 | Ryu et al. | |
| 2021/0166608 | A1* | 6/2021 | Guo | G09G 3/2074 |

FOREIGN PATENT DOCUMENTS

| | | | |
|---|---|---|---|
| CN | 109559696 | A | 4/2019 |
| CN | 109658892 | A | 4/2019 |
| CN | 110136627 | A | 8/2019 |
| CN | 110164374 | A | 8/2019 |
| CN | 110956926 | A | 4/2020 |

* cited by examiner

DISPLAY SCREEN, DRIVE CONTROL METHOD AND DRIVE-CONTROL APPARATUS THEREOF

CROSS-REFERENCE TO RELATED PATENT APPLICATION

This application is a continuation application of International Patent Application No. PCT/CN2020/137170, filed on Dec. 17, 2020, which itself claims priority to Chinese Patent Application No. 201911366418.3 filed in China on Dec. 26, 2019. The disclosure of each of the above applications is incorporated herein in its entirety by reference.

FIELD OF THE INVENTION

The present invention relates to a display driving technology of display screens, in particular to a drive-control method and drive-control apparatus of display screens, and a display screen adopting the drive-control method and/or the drive-control apparatus.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

At present, liquid crystal displays (LCD), organic light-emitting diode (OLED) displays, and micro-light-emitting diode (Micro-LED) displays prevail among the existing display screens. Although the display and light-emitting principles of various displays such as a LCD, an OLED, and a Micro-LED are different, their pixel arrays and their control circuits are basically the same. FIG. 1 shows the general circuit model of display screens having sub-pixel resolution of M*N, which contains N row channels and M column channels. In the figure, RX is the lumped resistance of the column channel X, $C_{net_X}$ is the line lumped capacitance of the column channel X, $C_{s_Y,X}$ is the lumped storage capacitance of the pixel circuit in the $Y^{th}$ row of the column channel X, and $C_{net_X}$ is much larger than $C_{S_Y,X}$.

As shown by the pixel array and control circuit of display screens in FIG. 1, the drive-control includes row drive-control and column drive-control. The row drive-control is mainly performed for row scanning, upon a certain row being scanned, the row drive-control circuit concurrently engages all pixel circuits in this row, while the column drive-control is performed for charging and discharging all the pixel circuits of the scanned row to reach a target gray-scale voltage. When scanning to a certain row, the charging-discharging principle of one among the column channels can be further modeled as shown in FIG. 2, with a charging-discharging model being actually a resistor-capacitor series charging-discharging circuit. In FIG. 2, R is the lumped resistance on a column channel, C is the lumped capacitance on a column channel, and the luminance of the sub-pixel depends on the final voltage across the capacitor C.

The traditional column drive-control method to charge and discharge each column channel with a set of separate circuits, in addition to the need for a series of gray-scale voltage generating circuits, also requires a separate digital-to-analog converter (DAC) and a separate output gain amplifier for each column channel to charge and discharge each column channel load. The specific driving circuit schematic diagram is shown in FIG. 3.

As for the display screen shown in FIG. 1, assuming that the number of column channels in necessity to concurrently charge and discharge is M and the image gray-scale accuracy is P, the traditional drive-control method requires at least M digital-to-analog converters DACs, M output gain amplifiers (OP), a series of gray-scale voltage generating circuits (Dm) and M*P level shifts. It can be seen from FIG. 3 that the traditional column drive-control method not only has a large-scale circuit, but also has high costs and high power consumption.

It has become a problem to be solved urgently to overcome the defects of the existing drive-control method with a large-scale circuit, high costs, and high power consumption.

SUMMARY OF THE INVENTION

In view of this, the example embodiments of the present invention provide a drive-control method and drive-control apparatus of display screens, and a display screen having the drive-control apparatus, so as to eliminate or ameliorate one or more defects in the prior art.

According to one aspect of the present invention, a drive-control method of display screens is provided, and in the column drive-control process of the pixel array of display screens, the method has at least one charging-discharging stage, and each charging-discharging stage includes the following steps:

- determining a staged target gray-scale value of all sub-pixels in the currently scanned row of the pixel array of display screens;
- based on a current gray-scale value of each sub-pixel, the staged target gray-scale value and a pre-stored look-up table, determining the charging-discharging target count corresponding to each column channel in the current scan row, wherein said look-up table stores the mapping relationship between the different initial gray-scale values of the sub-pixels and the charging-discharging target counts at changing to the particular staged target gray-scale values;
- controlling the charging-discharging switches in the charging-discharging circuits of each column channel to charge each column channel by using the maximum gray-scale value of the sub-pixel in pixel arrays or discharge each column channel by using the minimum gray-scale value of the sub-pixel in pixel arrays, using a counter to count the charging-discharging time of each column channel based on a predetermined clock cycle, comparing the count of the counter with the target counts corresponding to each column channel, respectively, based on the comparison results, controlling the charging-discharging switches of the charging-discharging circuits of each column channel, respectively, so as to terminate the charging-discharging of the column channel, when the count of the counter is consistent with the target count corresponding to the charging or discharging of each column channel.

In some embodiments, wherein said at least one charging-discharging stage refers to one charging-discharging stage;

- said step of determining the staged target gray-scale value of all sub-pixels in the currently scanned row of the pixel array of display screens includes: determining whether to charge or discharge each column channel based on the original gray-scale value corresponding to each column channel in the current scan row and the original gray-scale value corresponding to the previous scan row, thereby determining the staged target gray-scale value of all sub-pixels in the current row.

In some embodiments, wherein said step of determining whether to charge or discharge each column channel based on the original gray-scale value corresponding to each column channel in the current scan row and the original gray-scale value corresponding to the previous scan row includes: if the original gray-scale value corresponding to the current scan row of the same column channel is greater than or equal to the original gray-scale value corresponding to the previous scan row, determining to charge the current column channel, otherwise determining to discharge the current column channel;

said step of based on a current gray-scale value of each sub-pixel, the staged target gray-scale value and a pre-stored look-up table, determining the charging-discharging target count corresponding to each column channel in the current scan row, includes:

in the case that it is determined to charge the current column channel, using the original gray-scale values of the current column channel respectively positioned in the current scan row and the previous scan row as an input to the look-up table to obtain the first charging-discharging target count and the second charging-discharging target count, respectively, using the absolute value of the difference between the first charging-discharging target count and the second charging-discharging target count as a charging-discharging target count according to the current column channel;

in the case that it is determined to discharge the current column channel, using the difference between the maximum gray-scale value of the sub-pixel and the original gray-scale value of the current column channel corresponding to the current scan row and the difference between the maximum gray-scale value of the sub-pixel and the original gray-scale value of the current column channel corresponding to the previous scan row as an input to the look-up table, respectively, to obtain the first charging-discharging target count and the second charging-discharging target count, respectively, using the absolute value of the difference between the first charging-discharging target count and the second charging-discharging target count as a charging-discharging target count according to the current column channel.

In some embodiments, wherein said at least one charging-discharging stage includes an initial charging-discharging stage and a formal charging-discharging stage;

at said initial charging-discharging stage, said step of determining the staged target gray-scale value of all sub-pixels in the currently scanned row of the pixel array of display screens includes: determining the average gray-scale value of all sub-pixels in the current row and the average gray-scale value of all sub-pixels in the previous row, and determining whether to charge or discharge each column channel based on the average gray-scale value of the current row and the average gray-scale value of the previous row, thereby determining the staged target gray-scale value of all sub-pixels;

at said formal charging-discharging stage, said step of determining the staged target gray-scale value of all sub-pixels in the currently scanned row of the pixel array of display screens includes: after determining the initial charging-discharging stage, when the gray-scale value of all sub-pixels in the current row is the minimum gray-scale value of the sub-pixel, determining to charge the current column channel, thereby determining the staged target gray-scale value of all the sub-pixels to be the maximum gray-scale value of the sub-pixel; after determining the initial charging-discharging stage, when the gray-scale value of all sub-pixels in the current row is the maximum gray-scale value, determining to discharge the current column channel, thereby determining the staged target gray-scale value of all sub-pixels to be the minimum gray-scale value of the sub-pixel.

In some embodiments, wherein said step of determining the average gray-scale value of all sub-pixels in the current row and the average gray-scale value of all sub-pixels in the previous row, and determining whether to charge or discharge each column channel based on the average gray-scale value of the current row and the average gray-scale value of the previous row includes:

if the sum of the average gray-scale value of all sub-pixels in the current row and the average gray-scale value of all sub-pixels in the previous row is greater than or equal to the sum of the maximum gray-scale value of the sub-pixel and the minimum gray-scale value of the sub-pixel, determining to charge the current column channel, otherwise determining to discharge the current column channel.

In some embodiments, wherein at said initial charging-discharging stage and said formal charging-discharging stage:

said step of based on the current gray-scale value of each sub-pixel, the staged target gray-scale value and a pre-stored look-up table, determining the charging-discharging target count corresponding to each column channel in the current scan row, includes: in the case of determining to charge the current column channel, using the original gray-scale value corresponding to the current column channel in the current scan row as an input to the look-up table, and using the obtained charging-discharging target count as the charging-discharging target count corresponding to the current column channel;

in the case of determining to charge the current column channel, using the difference between the maximum gray-scale value of the sub-pixel and the original gray-scale value of the current column channel corresponding to the current scan row as an input to the look-up table, and using the obtained charging-discharging target count as the charging-discharging target count corresponding to the current column channel.

In some embodiments, wherein when the counter count reaches the maximum target count in the charging-discharging target count, the counter is cleared to zero.

In some embodiments, a drive-control apparatus of display screens, comprising: a row drive-control circuit and a column drive-control circuit, wherein said column drive-control circuit includes:

a column channel charging-discharging circuit which is used to charge each column channel in the pixel array of display screens by using the maximum gray-scale value of the sub-pixel in pixel arrays or discharge each column channel in the pixel array of display screens by using the minimum gray-scale value of the sub-pixel in pixel arrays, each column channel being connected with a charging-discharging switch;

a counter which is used to count the charging-discharging time of the charging-discharging circuit of the entire column channel based on a clock cycle;

a plurality of comparators, to each of which the first input is the count of said counter, and the second input is the charging-discharging target count corresponding to each column channel, and based on the input count of the counter and the charging-discharging target count, which control the charging-discharging switches corresponding to each column channel in the column channel charging-discharging circuit, wherein the number of said comparators is the same as the number of said column channels;

a controlling component which is used to determine the staged target gray-scale value of all sub-pixels in the current scan row, based on the current gray-scale value of each sub-pixel, the staged target gray-scale value and a pre-stored look-up table, determine the charging-discharging target count corresponding to each column channel in the current scan row, send the charging-discharging target count to the corresponding comparator, and based on the charging-discharging state of the column channel charging-discharging circuit, control the count of the counter, wherein said look-up table stores the mapping relationship between the different initial gray-scale values of the sub-pixels and the charging-discharging target counts at changing to the particular staged target gray-scale values.

In some embodiments, wherein said controlling component determines whether to charge or discharge each column channel based on the original gray-scale value corresponding to each column channel in the current scan row and the original gray-scale value corresponding to the previous scan row, thereby determining the staged target gray-scale value of all sub-pixels in the current row.

In some embodiments, wherein in the case that it is determined to charge the current column channel, said controlling component uses the original gray-scale values of the current column channel respectively positioned in the current scan row and the previous scan row as an input to the look-up table to obtain the first charging-discharging target count and the second charging-discharging target count, respectively, and uses the absolute value of the difference between the first charging-discharging target count and the second charging-discharging target count as a charging-discharging target count according to the current column channel;

in the case that it is determined to discharge the current column channel, said controlling component uses the difference between the maximum gray-scale value of the sub-pixel and the original gray-scale value of the current column channel corresponding to the current scan row and the difference between the maximum gray-scale value of the sub-pixel and the original gray-scale value of the current column channel corresponding to the previous scan row as an input to the look-up table, respectively, to obtain the first charging-discharging target count and the second charging-discharging target count, respectively, and uses the absolute value of the difference between the first charging-discharging target count and the second charging-discharging target count as a charging-discharging target count according to the current column channel.

In some embodiments, wherein said column channel charging-discharging circuit includes 2M charging-discharging switches, each column channel is connected with 2 charging-discharging switches respectively used to charge and discharge the column channels, where M is the number of column channels.

In some embodiments, wherein the operation state of said controlling component includes an initial charging-discharging stage and a formal charging-discharging stage;

at said initial charging-discharging stage, said controlling component determines the average gray-scale value of all sub-pixels in the current row and the average gray-scale value of all sub-pixels in the previous row, and determines whether to charge or discharge each column channel based on the average gray-scale value of the current row and the average gray-scale value of the previous row, thereby determining the staged target gray-scale value of all sub-pixels;

at said formal charging-discharging stage, after determining the initial charging-discharging stage, when the gray-scale value of all sub-pixels in the current row is the minimum gray-scale value of the sub-pixel, said controlling component determines to charge the current column channel, thereby determining the staged target gray-scale value of all the sub-pixels to be the maximum gray-scale value of the sub-pixel; after determining the initial charging-discharging stage, when the gray-scale value of all sub-pixels in the current row is the maximum gray-scale value, said controlling component determines to discharge the current column channel, thereby determining the staged target gray-scale value of all sub-pixels to be the minimum gray-scale value of the sub-pixel.

In some embodiments, wherein in the case of determining to charge the current column channel, said controlling component uses the original gray-scale value corresponding to the current column channel in the current scan row as an input to the look-up table, and uses the obtained charging-discharging target count as the charging-discharging target count corresponding to the current column channel;

in the case of determining to charge the current column channel, said controlling component uses the difference between the maximum gray-scale value of the sub-pixel and the original gray-scale value of the current column channel corresponding to the current scan row as an input to the look-up table, and uses the obtained charging-discharging target count as the charging-discharging target count corresponding to the current column channel.

In some embodiments, wherein said column channel charging-discharging circuit includes 2 charging-discharging changeover switches and shared by each column channel, and M charging-discharging switches respectively connected to M column channels, said charging-discharging changeover switches are controlled by said controlling component, said M charging-discharging switches are used to coordinate with the two charging-discharging changeover switches to realize charging and discharging M column channels, where M is the number of column channels.

In some embodiments, wherein when the counter count reaches the maximum target count in the charging-discharging target count, said controlling component clears the counter to zero.

According to another aspect of the present invention, a display screen is also provided, including the drive-control apparatus of the display screen as described above. The display screen, and drive-control method and drive-control apparatus thereof according to the present invention can charge and discharge all column channels to their respective target gray-scale voltages only by means of a counter, digital comparators in the same number with the column channels, and several charging-discharging switch circuits, not only with a simple structure, but also a small-scale circuit and low costs and power consumption.

The additional advantages, objectives, and features of the present invention will be partially explained in the following description, and they will become partially obvious for a person skilled in the art after studying the following part, or can be learned from putting the present invention into practice. The objectives and other advantages of the present invention can be realized and obtained by way of the structure specified in the written description, its claims, and the drawings.

A person skilled in the art will understand that the objectives and advantages achievable in the present invention are not limited to the above specific descriptions, and the above objectives and other objectives achievable in the present invention will be more clearly understood based on the following detailed description.

BRIEF DESCRIPTION OF THE DRAWINGS

The drawings described herein are used to provide further understanding of the present invention, constituting a part of this application, but do not impose limitations on the present invention. The components in the drawings are not drawn to scale, but merely to illustrate the principle of the present invention. In order to facilitate the illustration and description of some parts of the present invention, corresponding parts in the drawings may be enlarged, that is, may become larger than the other components in the exemplary device actually manufactured according to the present invention. In the drawings.

DETAILED DESCRIPTION OF EMBODIMENTS

Figure 1:
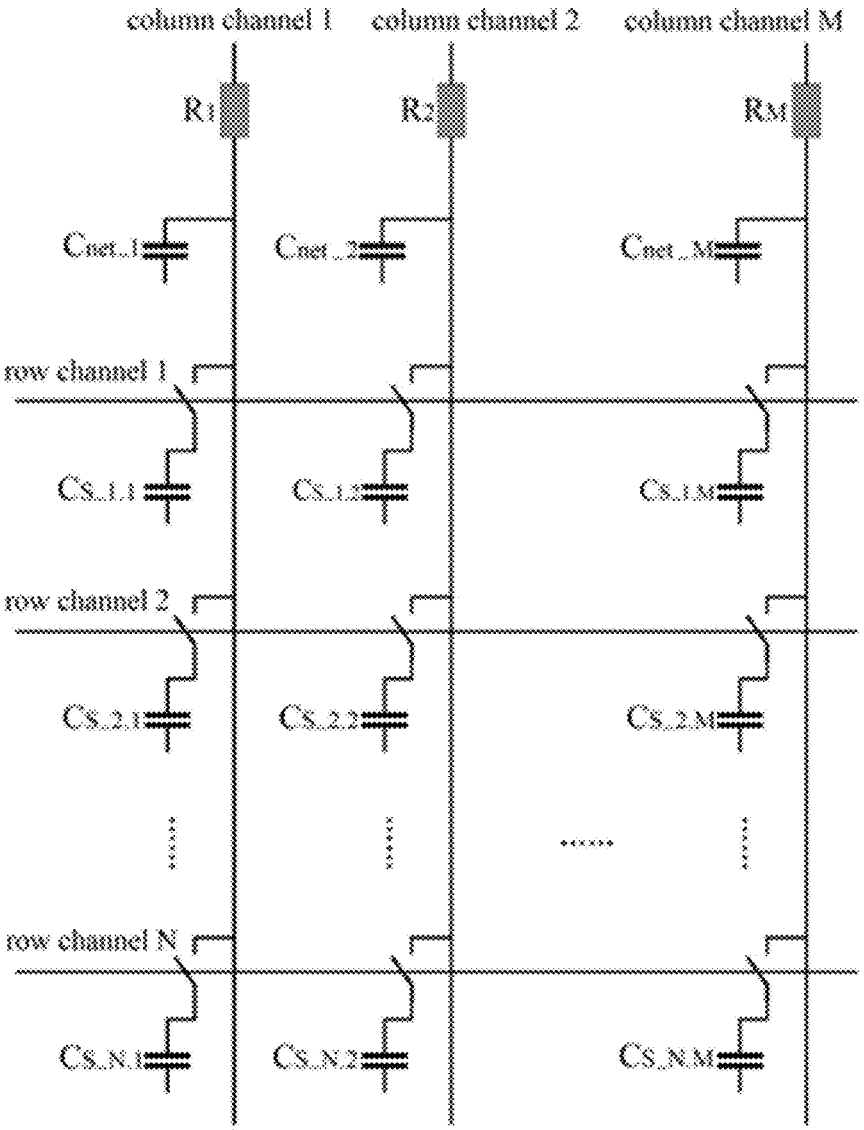
FIG. 1 is a schematic diagram of a pixel array of a traditional display screen and a control circuit thereof.

In order to make the objectives, technical solutions, and advantages of the present invention clearer, we will further describe the present invention in detail in combination with the embodiments and the accompanying drawings as follows. The exemplary embodiments and description are herein used to explain the present invention, but not as a limitation to the present invention.

It should also be herein noted that, in order to avoid confusing the present invention due to unnecessary details, only the structure and/or processing steps closely related to the technical solution according to the present invention are shown in the drawings, while the other details irrelevant to the present invention are omitted.

It should be stressed that the term "comprising/including" used herein refers to the existence of features, elements, steps or components, but does not exclude the existence or addition of one or more other features, elements, steps or components.

It should also be herein noted that, if not specified, the term "connection" herein can not only refer to a direct connection, but also an indirect connection via a medium.

Hereinafter, we will describe the embodiments of the present invention in combination with the drawings. In the drawings, the same reference signs represent the same or similar components or the same or similar steps.

Figure 2:
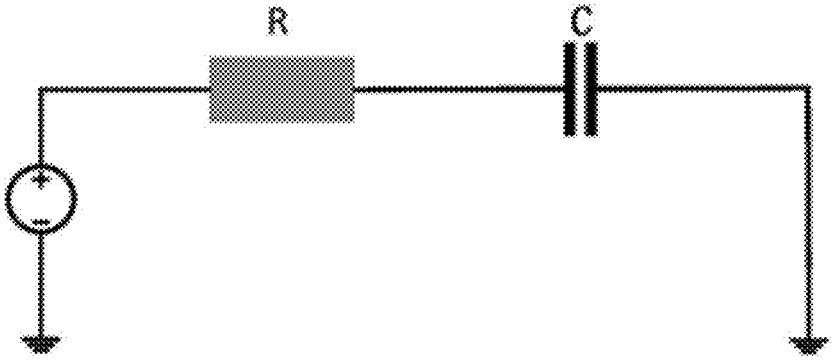
FIG. 2 is a schematic modeled diagram of the charging-discharging principle of the column channels in the pixel array.
Figure 3:
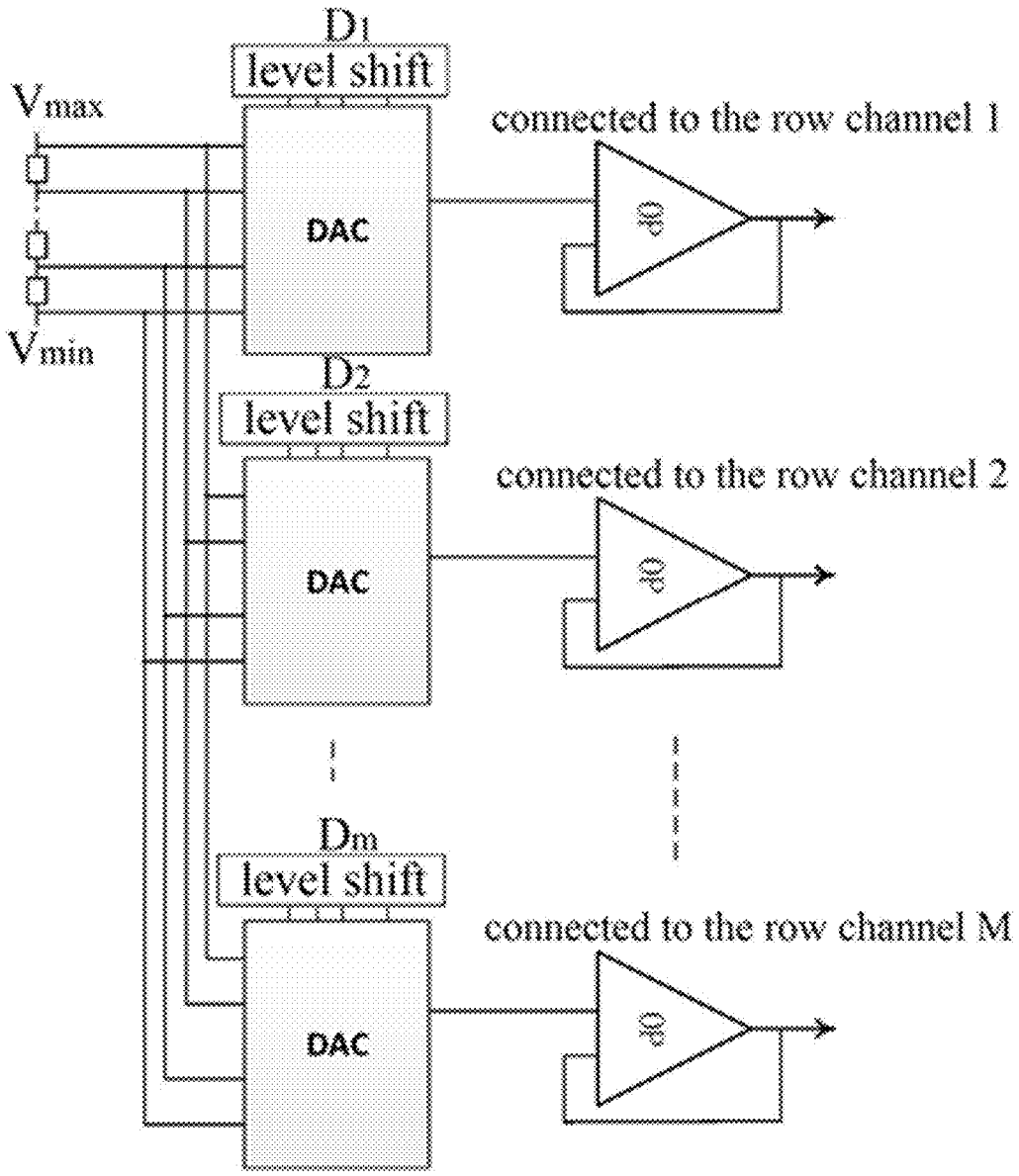
FIG. 3 is a schematic diagram of a traditional column channel drive circuit.

According to the charging-discharging principle of the circuit corresponding to the schematic modeled diagram of FIG. 2, the mathematical formula of the voltage across the capacitor in the resistor-capacitor series circuit with time changes Uc(t) as shown in Formula (1) and Formula (2):

$$U_C(t) = U_0\left(1 - e^{-\frac{t}{RC}}\right) \tag{1}$$

$$U_C(t) = U_0 e^{-\frac{t}{RC}} \tag{2}$$

Wherein, Formula (1) shows the relationship of the voltage $U_c$ cross the capacitor changing from zero to $U_0$ over time, Formula (2) shows the relationship of the voltage $U_c$ cross the capacitor changing from $U_0$ to zero over time, wherein $U_0$ represents the target voltage to be charged cross the capacitor or the initial voltage at discharging, e represents a natural logarithm, R represents a resistance value of the resistor, C represents a value of the capacitor, and t represents time. The product of R and C is defined as the time constant $\tau$ (that is, $\tau$=R*C), by which it is generally considered that at the time t=5*$\tau$ the capacitor has been charged and discharged. In practice, the charging-discharging constants of each column channel of display screens are almost the same or have slight difference, so the charging-discharging constants T of each column channel can be temporarily deemed the same, marked as $\tau_a$.

The present invention is designed based on the above Formula (1) and Formula (2). The specific principles are as follows.

It is assumed that the maximum gray-scale value of the sub-pixel in the pixel array is $D_{max}$ (if the image gray-scale accuracy is P, then $D_{max}$ is the $P^{th}$ power of 2), the corresponding gray-scale voltage is $V_{max}$ (usually the power supply voltage of $U_0$), the minimum gray-scale value of the sub-pixel is $D_{min}$ (usually zero), and the corresponding gray-scale voltage is $V_{min}$ (usually the ground voltage of zero), meanwhile there is $(V_{max}+V_{min})=U_0$. Assuming that the time required to take a charge of $\Delta V$ from $V_{min}$ to is $t_1$, and the time required to take a discharge of $\Delta V$ from $V_{max}$ is $t_2$, according to Formula (1) and Formula (2), $t_1$ and $t_2$ can be solved as:

$$t_1 = RC * \ln\frac{U_0}{U_0 - V_{min} - \Delta V} \tag{3}$$

$$t_2 = RC * \ln\frac{U_0}{V_{max} - \Delta V}. \tag{4}$$

And because of $(V_{max}+V_{min})=U_0$, $t_1$ is equal to $t_2$, which means that the time required for charging from $V_{max}$ is the same with that required for discharging of the same voltage $\Delta V$ from $V_{min}$.

Hereby, assuming that the time required for each column channel to charge from $V_{min}$ to $V_{max}$ or from $V_{max}$ to $V_{min}$ is $T_A$, in the present invention, the charging-discharging time $T_A$ is counted by adding 1 for each clock cycle (the clock cycle is $T_C$) of a clock from zero. The calculated maximum value is marked as $E_{max}$ ($E_{max}$ is the integer selected below the quotient of $T_A$ divided by $T_C$), where the clock cycle $T_C$ is selected so that the value of $E_{max}$ is suitably greater than 16 times of the value of $D_{max}$.

Since the time required for each column channel to be charged from $V_{min}$ to $V_{max}$ or from $V_{max}$ to $V_{min}$ is the same, a look-up table is used in the embodiments of the present invention to map the original gray-scale value of the sub-pixel G (G is greater than or equal to $D_{min}$, and meanwhile less than or equal to $D_{max}$) as a value Y counted by a counter from 0 to $E_{max}$ What is stored in the look-up table is the mapping relationship between the different initial gray-scale values of the sub-pixels and the charging-discharging target counts at changing the gray-scale value to the target gray-scale value ($D_{max}$ or $D_{min}$). If required to charge the column channel, the input to the look-up table is G, if required to discharge the column channel, the input to the look-up table is ($D_{max}$-G), and the output from the look-up table is Y, which is the target count value corresponding to the charging-discharging target gray-scale voltage. Therefore, the idea of the present invention is to provide a drive-control circuit of display screens and a control method thereof, wherein a counter is used to count the charging-discharging processes of the column channels, upon counting to the target count value, so as to complete charging the column channels, without a digital-to-analog converter DAC, a gain amplifier, a gray-scale voltage generating circuit, level shifts and other complex circuit structures.

The drive-control circuit of display screens of the present invention can have multiple implementation modes, and several examples will be listed below.

Figure 4:
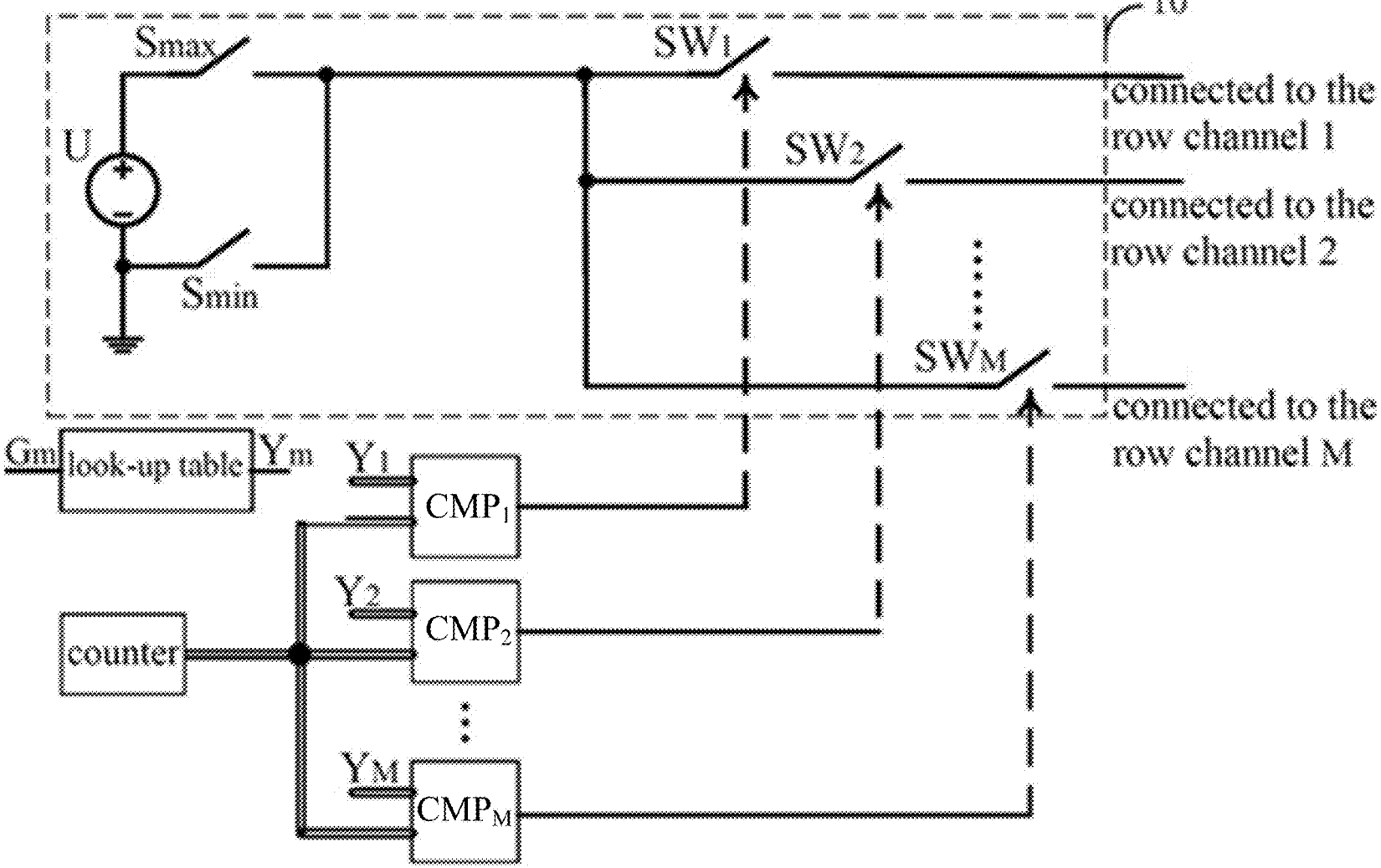
FIG. 4 is a schematic diagram of the drive-control circuit of display screens in one embodiment of the present invention.

FIG. 4 is a schematic diagram of the drive-control circuit of display screens in one embodiment of the present invention. As shown in FIG. 4, the drive-control circuit is used for charging control of M column channels, including: a column channel charging-discharging circuit 10, a counter, and M comparators CMPm (m=1, 2, . . . , M) and a controlling component (not shown in the figure).

The column channel charging-discharging circuit 10 is used to charge and discharge each column channel connected with a charging-discharging switch, in the pixel array of display screens. In the example shown in FIG. 4, the column channel charging-discharging circuit includes: a charging-discharging power supply U, 2 charging-discharging changeover switches $S_{max}$ and $S_{min}$ shared by each column channel, and M charging-discharging switches $SW_1$, $SW_2$, . . . , $SW_M$ respectively connected to M column channels. The charging-discharging changeover switches $S_{max}$ and $S_{min}$ can be controlled by the controlling component, while M charging-discharging switches can be controlled by M comparators, being used to coordinate with the two charging-discharging changeover switches to realize charging and discharging M column channels. In the embodiment of the present invention, the M charging-discharging switches may be, for example, a triode switch, but the present invention is not limited to this.

The counter is used to count the charging time of the charging-discharging circuit of the entire column channel based on the clock cycle $T_C$. The clock cycle $T_C$ is selected so that the value of $E_{max}$ is suitably greater than 16 times of the value of $D_{max}$.

The first input to each comparator $CMP_m$ in the M comparators is the count of the counter, and the second input is the charging-discharging target count $Y_m$ corresponding to each column channel, based on the input count of the counter and the charging-discharging target count $Y_m$, CMPm controls the charging-discharging switches $SW_m$ corresponding to each column channel in the column channel charging-discharging circuit. In the embodiment of the present invention, the charging-discharging target count $Y_m$ corresponding to each column channel is determined by the controlling component searching through the look-up table and provided to the comparator. In the embodiment of the present invention, the output from the comparator can be used as a bias voltage to be input to the base electrode of the charging-discharging changeover switches, thereby controlling the on-off of the charging-discharging changeover switches, but the present invention is not limited to this, and may also adopt other control mode.

The controlling component connected with the counter and the comparator is used to determine the staged target gray-scale value of all sub-pixels in the current scan row, based on the current gray-scale value of each sub-pixel, the staged target gray-scale value and a pre-stored look-up table, determine the charging-discharging target count corresponding to each column channel in the current scan row, send the charging-discharging target count to the corresponding comparator, and based on the charging-discharging state of the column channel charging-discharging circuit, control the count of the counter. In the embodiment of the present invention, the controlling component may be a single-chip microcomputer, a field programmable gate array (FPGA), etc., but the present invention is not limited to this.

In the embodiment corresponding to FIG. 4, the controlling component divides the process from the charging-discharging of all column channels to their respective target gray-scale voltages into two stages. The first stage is to initialize the voltage for all column channels (or called the initial charging-discharging stage, which may be referred to as Initialization Stage), and the second stage is to charge and discharge all the channels to their target gray-scale voltage (may be called the formal charging-discharging stage).

In other words, the operation state of the controlling component includes the initial charging-discharging stage and the formal charging-discharging stage. At the initial charging-discharging stage, the controlling component determines the average gray-scale value of all sub-pixels in the current row and the average gray-scale value of all sub-pixels in the previous row, and determines whether to charge or discharge each column channel based on the average gray-scale value of the current row and the average gray-scale value of the previous row, thereby determining the staged target gray-scale value of all sub-pixels.

As shown in FIG. 4, before scanning each row to charge and discharge all the column channels, all the switches used for charging-discharging ($S_{min}$, $S_{max}$, $SW_1$ . . . $SW_M$ in the figure) are in the off state, and the counter value CNT is cleared to zero. Assuming that the average gray-scale value of all sub-pixels in the current row of the current image, scanned by the display screen, is $D_{ave}$, and the average gray-scale value of all sub-pixels in the previous row is $D_{ave\text{-}pre}$, at the first stage, the controlling component is to determine whether the average gray-scale value of all sub-pixels in the current row and the average gray-scale value of all sub-pixels in the previous row meet the following conditions: $(D_{max}-D_{ave\text{-}pre}+D_{max}-D_{ave})>(D_{ave\text{-}pre}-D_{min}+D_{ave}-D_{min})$, that is, $(D_{max}+D_{min})>(D_{ave\text{-}pre}+D_{ave})$, if yes, it is determined that the column channel should be discharged. It can be then determined that the target gray-scale value corresponding to each column channel of the initial charging-discharging stage of all sub-pixels is $D_{min}$. At the same time, when the controlling component determines to discharge the column channel, the difference between the maximum gray-scale value $D_{max}$ of the sub-pixel and the original gray-scale value $G_m$ corresponding to the current column channel in the current scan row (that is, $D_{max-Gm}$) is used as an input to the look-up table, and the charging-discharging target count obtained based on the look-up table is used as the charging-discharging target count $Y_m$ corresponding to the current column channel (that is, $Y_1$, $Y_2$, . . . , $Y_M$). After determining the charging-discharging target count $Y_m$, the controlling component can control the switch $S_{min}$ to be engaged, meanwhile, the counter and $Y_m$ actuate the comparator to engage the charging-discharging switches $SW_1$, . . . , $SW_M$ of all column channels. Of the counter starting counting, when the counter value CNT reaches $E_{max}$, it is cleared, at the same time, $S_{min}$ is disconnected, and all column channels are discharged to $V_{min}$. In the case that the controlling component determines to charge the column channels, the original gray-scale value (that is, $G_m$) corresponding to each column channel in the current scan row is used as an input to the lookup table, and the charging-discharging target count obtained based on the lookup table is used as the charging-discharging target count $Y_m$(that is, $Y_1$, $Y_2$, . . . , $Y_M$) corresponding to the current column channel. After determining the charging-discharging target count $Y_m$, the controlling component can control the switch $S_{max}$ to be engaged, meanwhile, the counter and $Y_m$ actuate the comparator to engage the charging-discharging switches $SW_1$, . . . , $SW_M$ of all column channels. Of the counter starting counting, when the counter value CNT reaches $E_{max}$, it is cleared, at the same time, $S_{max}$ is disconnected, and all column channels are discharged to $V_{max}$.

In this way, the first stage (initial charging-discharging stage) achieves the purpose of charging and discharging all column channels to the initial voltage ($V_{min}$ or $V_{max}$).

At the second stage (formal charging-discharging stage) contrary to the first stage, when determining that the first stage is to initialize the gray-scale values of all sub-pixels in the current row to the minimum gray-scale value of the sub-pixels (that is, all column channels are initialized to the voltage $V_{min}$), the controlling component will determine to charge the current column channel, and determines the staged target gray-scale value of all sub-pixels to be the maximum gray-scale value of the sub-pixel (that is, all column channels are to be charged to the voltage $V_{max}$). At this time, the switch $S_{max}$ is engaged to charge all the column channels, and the counter starts to count from zero. When the counter value CNT is equal to the value $Y_m$ mapped by searching through the look-up table, of the gray-scale value of the sub-pixel corresponding to one or more column channels, the charging-discharging switches of these column channels are cut. After completing charging these column channels, the counter continues to count to $E_{max}$ until completing charging all column channels, all the charging-discharging switches are cut, and the counter value is cleared to stop counting. When determining that the first stage is to initialize the gray-scale value of all sub-pixels in the current row to the maximum gray-scale value of the sub-pixel (that is, all column channels are initialized to the voltage $V_{max}$), the controlling component determines to charge the current column channel, and determines the staged target gray-scale value of all sub-pixels as the minimum gray-scale value of the sub-pixel (that is, all column channels are to be charged to the voltage $V_{min}$), and the switch $S_{min}$ is engaged to discharge all column channels. Meanwhile, of the counter starting counting from zero, when the counter value CNT is equal to the value $Y_m$ mapped by searching through the look-up table, of the gray-scale value of the sub-pixel corresponding to one or more column channels, the charging-discharging switches of these column channels are cut. After completing charging these channels, the counter continues to count to $E_{max}$ until completing discharging all column channels, their charging-discharging switches are then cut, and the counter value is cleared to stop counting.

So far, through two charging-discharging stages, the technical solution 1 of the present invention all completes the drive-control method for the column channels of the display screen.

As in the above embodiment, the Initialization Stage determines whether to discharge or charge each column channel based on the comparison between the sum of the average gray-scale value of the current row and the average gray-scale value of the previous row, and the sum of the maximum gray-scale value and the minimum gray-scale value, and determines the staged target gray-scale value of all sub-pixels. However, the present invention is not limited to this, and other methods can also be used to determine whether to charge or discharge each column channel. For example, it is also possible to determine whether to charge or discharge each column channel based on the comparison of the average gray-scale value of the current row and the average gray-scale value of the previous row. For example, if $D_{ave} \geq D_{ave-pre}$, it means that the column channel needs to be discharged at the Initialization Stage, otherwise it means that the column channel needs to be charged at the Initialization Stage.

As shown in FIG. 4, in this embodiment, only one one-by-one incrementing counter, M digital comparators, and M+2 charging-discharging switches are required to charge and discharge all column channels to their respective target gray-scale voltages, which not only simplifies the circuit structure and circuit scale, but also reduces the costs and power consumption.

Figure 5:
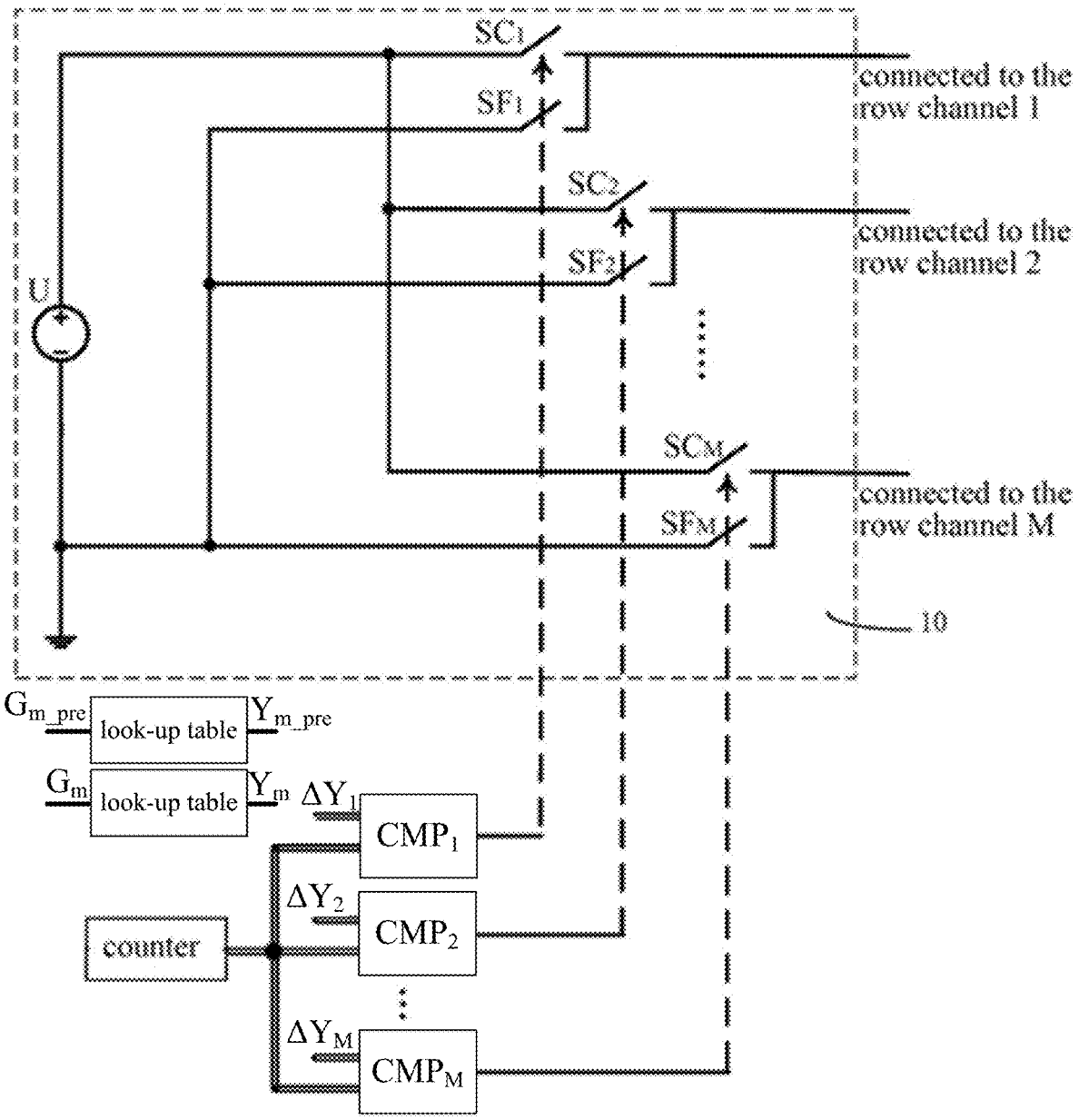
FIG. 5 is a schematic diagram of the drive-control circuit of display screens in another embodiment of the present invention.

FIG. 5 is a schematic diagram of the drive-control circuit of display screens in another embodiment of the present invention. As shown in FIG. 5, the drive-control circuit is used to charge and control M column channels, and the drive-control circuit includes: a column channel charging-discharging circuit 10, a counter, and M comparators CMPm (m=1, 2, . . . , M) and a controlling component (not shown in the figure).

In the example shown in FIG. 5, the column channel charging-discharging circuit 10 includes a charging-discharging power supply U, 2M charging-discharging switches (including M charging switches $SC_1$, $SC_2$, . . . , $SC_M$ and M discharging switches $SF_1$, $SF_2$, . . . , $SF_M$) respectively connected to M column channels, wherein each column channel is connected with 2 charging-discharging switches. The 2M charging-discharging switches can be controlled to be on-off by M comparators, each of which controls 1 charging switch and 1 discharging switch, which are respectively used to charge and discharge the column channels, so as to achieve charging and discharging M column channels.

The technical solution of the column channel control circuit shown in FIG. 5 (Solution 2) is different from the technical solution shown in FIG. 4 (Solution 1) in that the Solution 2 does not initialize the voltage for all column channels, instead has only one stage, at which all column channels are directly charged and discharged, but all column channels are charged and discharged from the target gray-scale voltage of the previous row. That is, in this embodiment, it is determined whether to charge or discharge each column channel based on the original gray-scale value corresponding to each column channel in the current scan row and the original gray-scale value corresponding to the previous scan row, thereby determining the staged target gray-scale value of all sub-pixels in the current row.

More specifically, as an example, if the original gray-scale value corresponding to the current scan row of the same column channel is greater than or equal to the original gray-scale value corresponding to the previous scan row, the controlling component determines to charge the current column channel, otherwise determines to discharge the current column channel. As shown in FIG. 5, assuming that the original gray-scale value of the current row of a certain column channel m is $G_m$, and the original gray-scale value of the previous row is $G_{m_pre}$. If $G_m \geq G_{m_pre}$, it means that the current row being scanned needs to be charged, meanwhile the look-up table is searched through for $G_m$ and $G_{m_pre}$ to attain $Y_m$ and $Y_{m_pre}$. If $G_m < G_{m_pre}$, it means that the current row being scanned needs to be discharged, meanwhile the look-up table is searched through for $(D_{max}-G_m)$ and $(D_{max}-G_{m_pre})$ to attain $Y_m$ and $Y_{m_pre}$, marking $\Delta Y_m$ as the absolute value of the difference between $Y_m$ and $Y_{m_pre}$, that is, $\Delta Y_m = |Y_m - Y_{m_pre}|$. $\Delta Y_m$ is used as one input to the digital comparator of this column channel, while the counter value CNT is used as another input to the comparator.

As shown in FIG. 5, before charging and discharging all column channels in the current row, all 2M charging-discharging switch circuits ($SC_1$, $SC_2$, . . . , $SC_M$ and $SF_1$, $SF_2$, . . . , $SF_M$ in FIG. 5) are in the off state, and the counter value CNT is cleared to zero. After starting charging and discharging, if a certain column channel needs to be charged at scanning the current row, the charging switch SCm is engaged, for the column channel that needs to be discharged, the discharging switch $SF_m$ is engaged, meanwhile, the counter starts counting from zero. When the counter value CNT is equal to the value $\Delta Y_m$ mapped by searching through the look-up table, of the gray-scale value of the sub-pixel corresponding to one or more column channels, the charging switches or discharging switches of these column channels are cut. After completing discharging and charging these column channels, the counter continues to count to $E_{max}$ until the charging-discharging switches of all the column channels are cut, meaning that all column channels have completed charging and discharging, and the counter value is cleared to stop counting.

Through above charging-discharging process, the technical solution 2 of the present invention all completes the drive-control method for the column channels of the display screen.

As shown in FIG. 5, in this embodiment, only one one-by-one incrementing counter, M digital comparators, and 2M charging-discharging switches are required to charge and discharge all column channels to their respective target gray-scale voltages, which not only simplifies the circuit structure and circuit scale, but also reduces the costs and power consumption.

The technical solution 1 shown in FIG. 4 and the technical solution 2 shown in FIG. 5 have advantages and disadvantages relative to each other, where the technical solution 1 has relatively large dynamic power consumption, but saves resources, while the technical solution 2 has relatively small dynamic power consumption, but needs relatively more circuit resources.

In another embodiment of the present invention, the column channel drive-control circuit shown in FIG. 5 may also adopt two stages to control the charging-discharging of the column channels, thus is different from the control method of the circuit shown in FIG. 4 in that there is an additional initialization stage, in which the controlling component determines whether to charge or discharge each column channel, based on the average gray-scale value of all sub-pixels in the current row and the average gray-scale value of all sub-pixels in the previous row. When it is determined that all column channels in the current row need to be charged, the charging switches $SC_m$ of all column channels are engaged. When it is determined that all column channels in the current row need to be charged, the discharging switches $SF_m$ of all column channels are engaged. The specific process will not be herein repeated.

At the second stage (formal charging-discharging stage) contrary to the first stage, when determining that the first stage is to initialize the gray-scale values of all sub-pixels in the current row to the minimum gray-scale value of the sub-pixels (that is, all column channels are initialized to the voltage $V_{min}$), the controlling component will determine to charge the current column channel, and determines the staged target gray-scale value of all sub-pixels to be the maximum gray-scale value of the sub-pixel (that is, all column channels are to be charged to the voltage $V_{max}$). At this time, all the charging switches $SC_1$, $SC_2$, . . . , $SC_M$ are engaged to charge all the column channels, and the counter starts to count from zero. When determining that the first stage is to initialize the gray-scale value of all sub-pixels in the current row to the maximum gray-scale value of the sub-pixel (that is, all column channels are initialized to the voltage $V_{max}$), the controlling component determines to charge the current column channel, and determines the staged target gray-scale value of all sub-pixels as the minimum gray-scale value of the sub-pixel (that is, all column channels are to be charged to the voltage $V_{min}$), and all discharging switch $SF_1$, $SF_2$, . . . $SF_M$ are engaged to charge all column channels, and the counter starts counting from zero.

In actual operation, the charging-discharging constants of each column channel of the display screen may have slight difference, and the maximum target count $E_{max}$ corresponding to the charging-discharging constant of each column channel can be obtained by way of assumption and detection. The specific method includes: from small to large assuming that the last $E_{max}$ used by the counter is a certain value Z, then the counter starting counting from zero, meanwhile charging all column channels from $V_{min}$ until the counter reaches Z, then stopping charging, checking the voltage on all column channels, where the $E_{max}$ corresponding to the charging-discharging constant of the column channel whose voltage reaches $V_{max}$ is the Z value at this time, incrementing the Z value by 1, and repeating the former steps for other column channels until the $E_{max}$ values of all column channels are found. If it is found that the $E_{max}$ values of each column channel have a relatively large difference with each other, it cannot be omitted. Of the column channel with a largest $E_{max}$ value, the $E_{max}$ value can be used as the last $E_{max}$ value used by the counter, while of other columns channel with smaller $E_{max}$ values, the corresponding gray-scale value of the sub-pixel may be compensated by the Y value mapped by searching through the look-up table, and then output to the digital comparator of this column channel.

The look-up table in the embodiment of the present invention can be combined with the digital gamma correction table into one table.

The above-mentioned drive-control circuit of display screens of the present invention adopts a pure digital method to uniformly charge and discharge all column channels, with the characteristics such as a simple structure, a small-scale circuit, low costs, and low power consumption.

Correspondingly, the present invention also provides a display screen including the above drive-control circuit of display screens.

Figure 6:
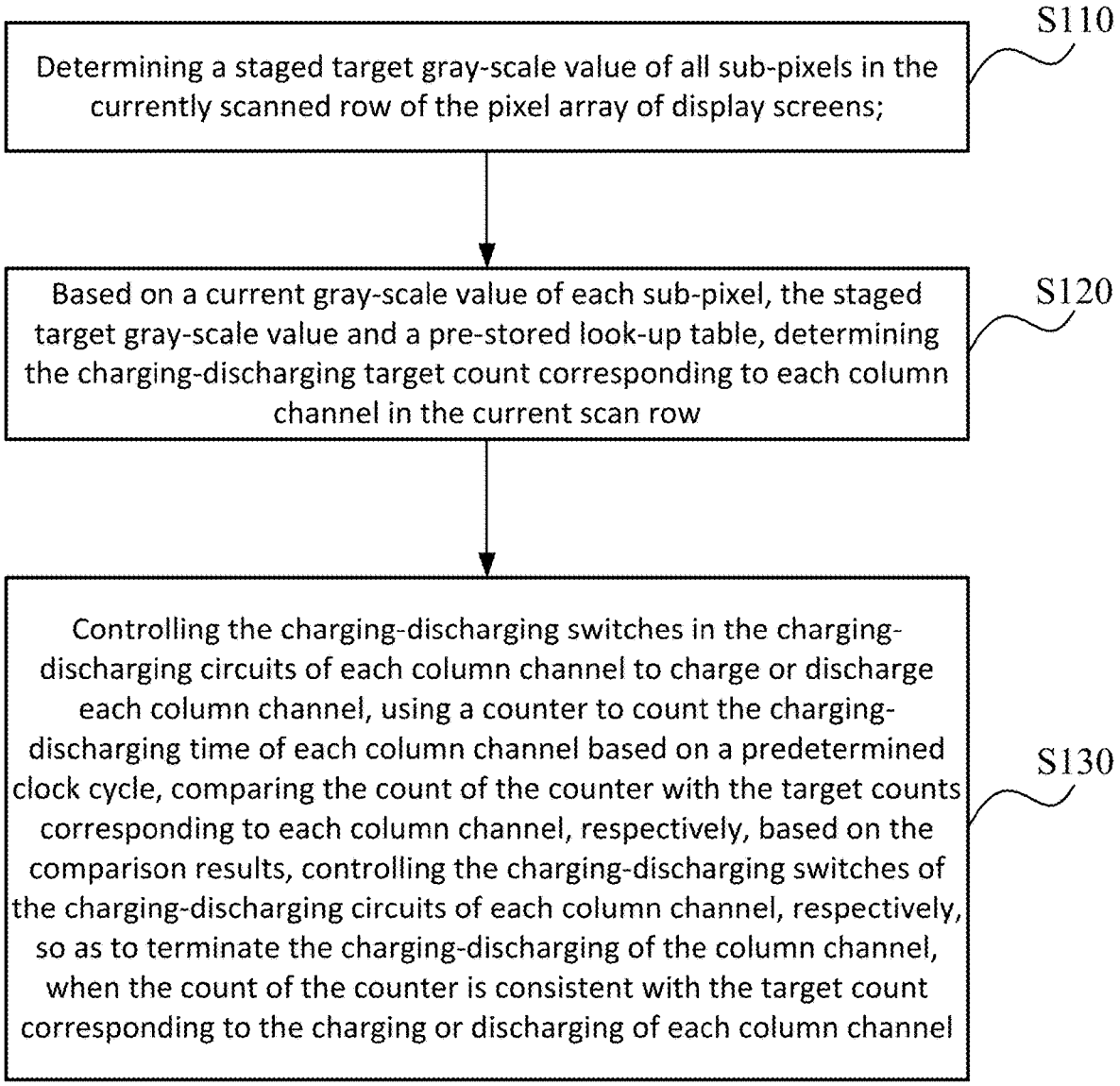
FIG. 6 is a schematic flowchart of the drive-control method of display screens in one embodiment of the present invention.

Correspondingly, the present invention also provides a drive-control method of display screens. In the column drive-control process of the pixel array of display screens, the method includes at least one charging-discharging stage, as shown in FIG. 6, each charging-discharging stage includes the following steps S110~S130:

Step S110: determining the staged target gray-scale value of all sub-pixels in the currently scanned row of the pixel array of display screens.

As mentioned above, in the case that the method includes only one charging-discharging stage without the Initialization Stage, this step may include: determining whether to charge or discharge each column channel based on the original gray-scale value corresponding to each column channel in the current scan row and the original gray-scale value corresponding to the previous scan row, thereby determining the staged target gray-scale value of all sub-pixels in the current row. For example, if the original gray-scale value corresponding to the current scan row of the same column channel is greater than or equal to the original gray-scale value corresponding to the previous scan row, it is determined to charge the current column channel, otherwise it is determined to discharge the current column channel, the staged target gray-scale value of all sub-pixels in the current row can thus be determined. In the case that the method includes the initial charging-discharging stage and the formal charging-discharging stage, the step in the Initialization Stage includes: determining the average gray-scale value of all sub-pixels in the current row and the average gray-scale value of all sub-pixels in the previous row, and determining whether to charge or discharge each column channel based on the average gray-scale value of the current row and the average gray-scale value of the previous row, thereby determining the staged target gray-scale value of all sub-pixels. For example, if the sum of the average gray-scale value of all sub-pixels in the current row and the average gray-scale value of all sub-pixels in the previous row is greater than or equal to the sum of the maximum gray-scale value of the sub-pixel and the minimum gray-scale value of the sub-pixel, it is determined to charge the current column channel, otherwise determined to discharge the current column channel, the staged target gray-scale value of all sub-pixels can be thus determined.

At the formal charging-discharging stage, this step includes: after determining the initial charging-discharging stage, when the gray-scale value of all sub-pixels in the current row is the minimum gray-scale value of the sub-pixel, determining to charge the current column channel, thereby determining the staged target gray-scale value of all the sub-pixels to be the maximum gray-scale value of the sub-pixel; after determining the initial charging-discharging stage, when the gray-scale value of all sub-pixels in the current row is the maximum gray-scale value, determining to discharge the current column channel, thereby determining the staged target gray-scale value of all sub-pixels to be the minimum gray-scale value of the sub-pixel.

Step S120: based on the current gray-scale value of each sub-pixel, the staged target gray-scale value and a pre-stored look-up table, determining the charging-discharging target count corresponding to each column channel in the current scan row.

For the technical solution without the Initialization Stage, this step can include: in the case that it is determined to charge the current column channel, using the original gray-scale values of the current column channel respectively positioned in the current scan row and the previous scan row as an input to the look-up table to obtain the first charging-discharging target count and the second charging-discharging target count, respectively, using the absolute value of the difference between the first charging-discharging target count and the second charging-discharging target count as a charging-discharging target count according to the current column channel; in the case that it is determined to discharge the current column channel, using the difference between the maximum gray-scale value of the sub-pixel and the original gray-scale value of the current column channel corresponding to the current scan row and the difference between the maximum gray-scale value of the sub-pixel and the original gray-scale value of the current column channel corresponding to the previous scan row as an input to the look-up table, respectively, to obtain the first charging-discharging target count and the second charging-discharging target count, respectively, using the absolute value of the difference between the first charging-discharging target count and the second charging-discharging target count as a charging-discharging target count according to the current column channel.

For the technical solution with the initial charging-discharging stage and the formal charging-discharging stage, this step can include: in the case of determining to charge the current column channel, using the original gray-scale value corresponding to the current column channel in the current scan row as an input to the look-up table, and using the obtained charging-discharging target count as the charging-discharging target count corresponding to the current column channel; in the case of determining to charge the current column channel, using the difference between the maximum gray-scale value of the sub-pixel and the original gray-scale value of the current column channel corresponding to the current scan row as an input to the look-up table, and using the obtained charging-discharging target count as the charging-discharging target count corresponding to the current column channel.

Step S130: controlling the charging-discharging switches in the charging-discharging circuits of each column channel to charge or discharge each column channel, using the counter to count the charging-discharging time of each column channel based on a predetermined clock cycle, comparing the count of the counter with the target counts corresponding to each column channel, respectively, based on the comparison results, controlling the charging-discharging switches of the charging-discharging circuits of each column channel, respectively, so as to terminate the charging-discharging of the column channel, when the count of the counter is consistent with the target count corresponding to the charging or discharging of each column channel.

Compared with the prior art, the column drive-control method of the present invention greatly reduces the complexity of effectuation, and reduces the costs and power consumption.

In the above embodiments, several circuit modes and specific steps are described and shown as examples. However, the method process of the present invention is not limited to the circuit modes and specific steps described and shown herein, and a person skilled in the art can make various changes, modifications and additions after understanding the essence of the present invention.

A person skilled in the art should understand that the exemplary components, systems, and methods described in combination with the embodiments disclosed herein can be implemented by hardware, software, or a combination of the two. It depends on the specific application and design constraint conditions of the technical solution whether to implement it by way of hardware or software. A person skilled in the art can use different methods for each specific application to effectuate the described functions, but such effectuation should not be deemed to go beyond the scope of the present invention. When implementing it by way of hardware, it may be, for example, an electronic circuit, an application specific integrated circuit (ASIC), appropriate firmware, a plug-in, a function card, and so on. When implementing it by way of software, the elements of the present invention are programs or code segments used to perform required tasks. The program or code segment may be stored in a machine-readable medium, or transmitted on a transmission medium or a communication link by a data signal carried in a carrier wave. A "machine-readable medium" may include any medium that can store or transmit information. Examples of machine-readable mediums include an electronic circuit, a semiconductor memory device, a ROM, a flash memory, an erasable ROM (EROM), a soft disk, a CD-ROM, an optical disk, a hard disk, an optical media, a radio frequency (RF) link, and so on. The code segment can be downloaded via a computer network such as the Internet, the Intranet, and so on.

It should also be noted that the exemplary embodiments mentioned herein present some methods or systems based on a series of steps or devices. However, the present invention is not limited to the sequence of the above steps, that is, the steps may be performed in the sequence mentioned in the embodiments, or may be different from the sequence in the embodiments, or several steps may be performed at the same time.

In the present invention, the features described and/or illustrated for one embodiment can be used in the same or similar manner in one or more other embodiments, and/or combined with the features of other embodiments or substituted for the features of other embodiments.

The above is only preferred embodiments of the present invention, not intended to limit the present invention, so a person skilled in the art may make various modifications and changes in the embodiments of the present invention. Any modification, equivalent replacement, improvement and the like made within the essence and principle of the present invention should be incorporated in the protection scope of the present invention.

What is claimed is:

1. A drive-control method of display screens, comprising: at least one charging-discharging stage in the column drive-control process of the pixel array of display screens, wherein each charging-discharging stage includes the following steps:

determining a staged target gray-scale value of all sub-pixels in the currently scanned row of the pixel array of display screens;

based on a current gray-scale value of each sub-pixel, the staged target gray-scale value and a pre-stored look-up table, determining the charging-discharging target count corresponding to each column channel in the current scan row, wherein said look-up table stores the mapping relationship between the different initial gray-scale values of the sub-pixels and the charging-discharging target counts at changing to the particular staged target gray-scale values; and controlling the charging-discharging switches in the charging-discharging circuits of each column channel to charge or discharge each column channel using a counter to count the charging-discharging time of each column channel based on a predetermined clock cycle, comparing the count of the counter with the target counts corresponding to each column channel, respectively, based on the comparison results, controlling the charging-discharging switches of the charging-discharging circuits of each column channel, respectively, so as to terminate the charging-discharging of the column channel, when the count of the counter is consistent with the target count corresponding to the charging or discharging of each column channel, wherein said at least one charging-discharging stage includes an initial charging-discharging stage and a formal charging-discharging stage;

wherein at said initial charging-discharging stage, said step of determining the staged target gray-scale value of all sub-pixels in the currently scanned row of the pixel array of display screens includes: determining the average gray-scale value of all sub-pixels in the current row and the average gray-scale value of all sub-pixels in the previous row, and determining whether to charge or discharge each column channel based on the average gray-scale value of the current row and the average gray-scale value of the previous row, thereby determining the staged target gray-scale value of all sub-pixels;

wherein at said formal charging-discharging stage, said step of determining the staged target gray-scale value of all sub-pixels in the currently scanned row of the pixel array of display screens includes: after determining the initial charging-discharging stage, when the gray-scale value of all sub-pixels in the current row is the minimum gray-scale value of the sub-pixel, determining to charge the current column channel, thereby determining the staged target gray-scale value of all the sub-pixels to be the maximum gray-scale value of the sub-pixel; after determining the initial charging-discharging stage, when the gray-scale value of all sub-pixels in the current row is the maximum gray-scale value, determining to discharge the current column channel, thereby determining the staged target gray-scale value of all sub-pixels to be the minimum gray-scale value of the sub-pixel.

2. The method according to claim 1, wherein said step of determining the average gray-scale value of all sub-pixels in the current row and the average gray-scale value of all sub-pixels in the previous row, and determining whether to charge or discharge each column channel based on the average gray-scale value of the current row and the average gray-scale value of the previous row includes:

if the sum of the average gray-scale value of all sub-pixels in the current row and the average gray-scale value of all sub-pixels in the previous row is greater than or equal to the sum of the maximum gray-scale value of the sub-pixel and the minimum gray-scale value of the sub-pixel, determining to charge the current column channel, otherwise determining to discharge the current column channel.

3. The method according to claim 2, wherein at said initial charging-discharging stage and said formal charging-discharging stage:

said step of based on the current gray-scale value of each sub-pixel, the staged target gray-scale value and a pre-stored look-up table, determining the charging-discharging target count corresponding to each column channel in the current scan row, includes: in the case of determining to charge the current column channel, using the original gray-scale value corresponding to the current column channel in the current scan row as an input to the look-up table, and using the obtained charging-discharging target count as the charging-discharging target count corresponding to the current column channel;

in the case of determining to charge the current column channel, using the difference between the maximum gray-scale value of the sub-pixel and the original gray-scale value of the current column channel corresponding to the current scan row as an input to the look-up table, and using the obtained charging-discharging target count as the charging-discharging target count corresponding to the current column channel.

4. The method according to claim 1, wherein when the counter count reaches the maximum target count in the charging-discharging target count, the counter is cleared to zero.

5. A drive-control apparatus of display screens, comprising: a row drive-control circuit and a column drive-control circuit, wherein said column drive-control circuit includes:

a column channel charging-discharging circuit which is used to charge and discharge each column channel connected with a charging-discharging switch, in the pixel array of display screens;

a counter which is used to count the charging-discharging time of the charging-discharging circuit of the entire column channel based on a clock cycle;

a plurality of comparators, to each of which the first input is the count of said counter, and the second input is the charging-discharging target count corresponding to each column channel, and based on the input count of the counter and the charging-discharging target count, which control the charging-discharging switches corresponding to each column channel in the column channel charging-discharging circuit, wherein the number of said comparators is the same as the number of said column channels;

a controlling component which is used to determine the staged target gray-scale value of all sub-pixels in the current scan row, based on the current gray-scale value of each sub-pixel, the staged target gray-scale value and a pre-stored look-up table, determine the charging-discharging target count corresponding to each column channel in the current scan row, send the charging-discharging target count to the corresponding comparator, and based on the charging-discharging state of the column channel charging-discharging circuit, control the count of the counter, wherein said look-up table stores the mapping relationship between the different initial gray-scale values of the sub-pixels and the charging-discharging target counts at changing to the particular staged target gray-scale values, wherein the operation state of said controlling component includes an initial charging-discharging stage and a formal charging-discharging stage;

wherein at said initial charging-discharging stage, said controlling component determines the average gray-scale value of all sub-pixels in the current row and the average gray-scale value of all sub-pixels in the previous row, and determines whether to charge or discharge each column channel based on the average gray-scale value of the current row and the average gray-scale value of the previous row, thereby determining the staged target gray-scale value of all sub-pixels;

wherein at said formal charging-discharging stage, after determining the initial charging-discharging stage, when the gray-scale value of all sub-pixels in the current row is the minimum gray-scale value of the sub-pixel, said controlling component determines to charge the current column channel, thereby determining the staged target gray-scale value of all the sub-pixels to be the maximum gray-scale value of the sub-pixel; after determining the initial charging-discharging stage, when the gray-scale value of all sub-pixels in the current row is the maximum gray-scale value, said controlling component determines to discharge the current column channel, thereby determining the staged target gray-scale value of all sub-pixels to be the minimum gray-scale value of the sub-pixel.

6. The apparatus according to claim 5, wherein said column channel charging-discharging circuit includes 2M charging-discharging switches, each column channel is connected with 2 charging-discharging switches respectively used to charge and discharge the column channels, where M is the number of column channels.

7. The apparatus according to claim 5, wherein in the case of determining to charge the current column channel, said controlling component uses the original gray-scale value corresponding to the current column channel in the current scan row as an input to the look-up table, and uses the obtained charging-discharging target count as the charging-discharging target count corresponding to the current column channel;

in the case of determining to charge the current column channel, said controlling component uses the difference between the maximum gray-scale value of the sub-pixel and the original gray-scale value of the current column channel corresponding to the current scan row as an input to the look-up table, and uses the obtained charging-discharging target count as the charging-discharging target count corresponding to the current column channel.

8. The apparatus according to claim 5, wherein said column channel charging-discharging circuit includes 2 charging-discharging changeover switches and shared by each column channel, and M charging-discharging switches respectively connected to M column channels, said charging-discharging changeover switches are controlled by said controlling component, said M charging-discharging switches are used to coordinate with the two charging-discharging changeover switches to realize charging and discharging M column channels, where M is the number of column channels.

9. The apparatus according to claim 5, wherein when the counter count reaches the maximum target count in the charging-discharging target count, said controlling component clears the counter to zero.

10. A display screen, comprising said drive-control apparatus of display screens according to claim 5.

* * * * *